US010514635B2

(12) United States Patent
Nesher et al.

(10) Patent No.: US 10,514,635 B2
(45) Date of Patent: Dec. 24, 2019

(54) LIQUID ELECTROSTATIC PRINTING METHOD

(71) Applicant: HP Indigo B.V., Amstelveen (NL)

(72) Inventors: Guy Nesher, Nes Ziona (IL); Boaz Tagansky, Nes Ziona (IL); Albert Teishev, Nes Ziona (IL); Martin Chauvin, Nes Ziona (IL); Reut Avigdor, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/307,361

(22) PCT Filed: Oct. 3, 2016

(86) PCT No.: PCT/EP2016/073546
§ 371 (c)(1),
(2) Date: Dec. 5, 2018

(87) PCT Pub. No.: WO2018/065026
PCT Pub. Date: Apr. 12, 2018

(65) Prior Publication Data

US 2019/0196368 A1 Jun. 27, 2019

(51) Int. Cl.
*G03G 15/16* (2006.01)
*G03G 9/125* (2006.01)

(52) U.S. Cl.
CPC ..... *G03G 15/169* (2013.01); *G03G 9/125* (2013.01)

(58) Field of Classification Search
CPC ..... G03G 15/169; G03G 9/125
See application file for complete search history.

(56) References Cited

U.S. PATENT DOCUMENTS 4,603,098 A 7/1986 Franke et al.
5,361,089 A 11/1994 Bearss et al.
(Continued)

FOREIGN PATENT DOCUMENTS

EP 1805563 7/2007
WO 2017020938 2/2017

OTHER PUBLICATIONS

Chovancova et al., Hot Melt Inks for 3D Printing, Ingenta Connect, NIP & Digital Fabrication Conference, Digital Fabrication 2005 Final Program and Proceedings.
(Continued)

*Primary Examiner* — Thorl Chea
(74) *Attorney, Agent, or Firm* — Thorpe North & Western LLP

(57) ABSTRACT

Herein is described a liquid electrostatic printing method comprising providing a liquid electrostatic ink composition comprising a carrier liquid and chargeable particles comprising a resin; and providing an adhesion promoting composition comprising an adhesion promoter. The liquid electrostatic ink composition is contacted with a latent electrostatic image disposed on a surface to create a developed ink image. The developed ink image is transferred to an intermediate transfer member. The adhesion promoting composition is deposited on the intermediate transfer member to form an adhesion promoting layer. The adhesion promoting layer and the developed ink image are transferred to a print substrate, such that the adhesion promoting layer is disposed on the print substrate and the developed ink image is disposed on the adhesion promoting layer.

15 Claims, 2 Drawing Sheets

(56) References Cited

U.S. PATENT DOCUMENTS

| | | | | |
|---|---|---|---|---|
| 6,187,498 | B1 | 2/2001 | Knapp et al. | |
| 7,790,244 | B2 | 9/2010 | Dungworth et al. | |
| 7,807,015 | B2 | 10/2010 | Ram et al. | |
| 2002/0197087 | A1 | 12/2002 | Caruthers, Jr. et al. | |
| 2007/0253751 | A1* | 11/2007 | Thaler | G03G 9/0926 399/296 |
| 2008/0118746 | A1* | 5/2008 | Klenk | B41M 5/52 428/336 |
| 2008/0252680 | A1 | 10/2008 | Schmid et al. | |
| 2011/0250418 | A1 | 10/2011 | Pitcher et al. | |
| 2015/0323889 | A1* | 11/2015 | Lior | G03G 15/0189 101/484 |

OTHER PUBLICATIONS

International Search Report dated Jun. 6, 2017 for PCT/EP2016/073546, Applicant Hewlett-Packard Indigo B.V.

* cited by examiner

LIQUID ELECTROSTATIC PRINTING METHOD

BACKGROUND

Liquid electrophotographic printing processes, sometimes termed liquid electrostatic printing processes, typically involve creating an image on a photoconductive surface, applying an ink having charged particles to the photoconductive surface, such that they selectively bind to the image, and then transferring the charged particles in the form of the image to a print substrate.

The photoconductive surface may be on a cylinder and is often termed a photo imaging plate (PIP). The photoconductive surface is selectively charged with a latent electrostatic image having image and background areas with different potentials. For example, an electrostatic ink composition including charged toner particles in a liquid carrier can be brought into contact with the selectively charged photoconductive surface. The charged toner particles adhere to the image areas of the latent image while the background areas remain clean. The image is then transferred to a print substrate (e.g. paper) directly or, by being first transferred to an intermediate transfer member, which can be a soft swelling blanket, which is often heated to fuse the solid image and evaporate the liquid carrier, and then to the print substrate.

In some existing liquid electrostatic printing methods, problems with adhesion of the ink image to the print substrate have been observed.

DETAILED DESCRIPTION

Figure 1:
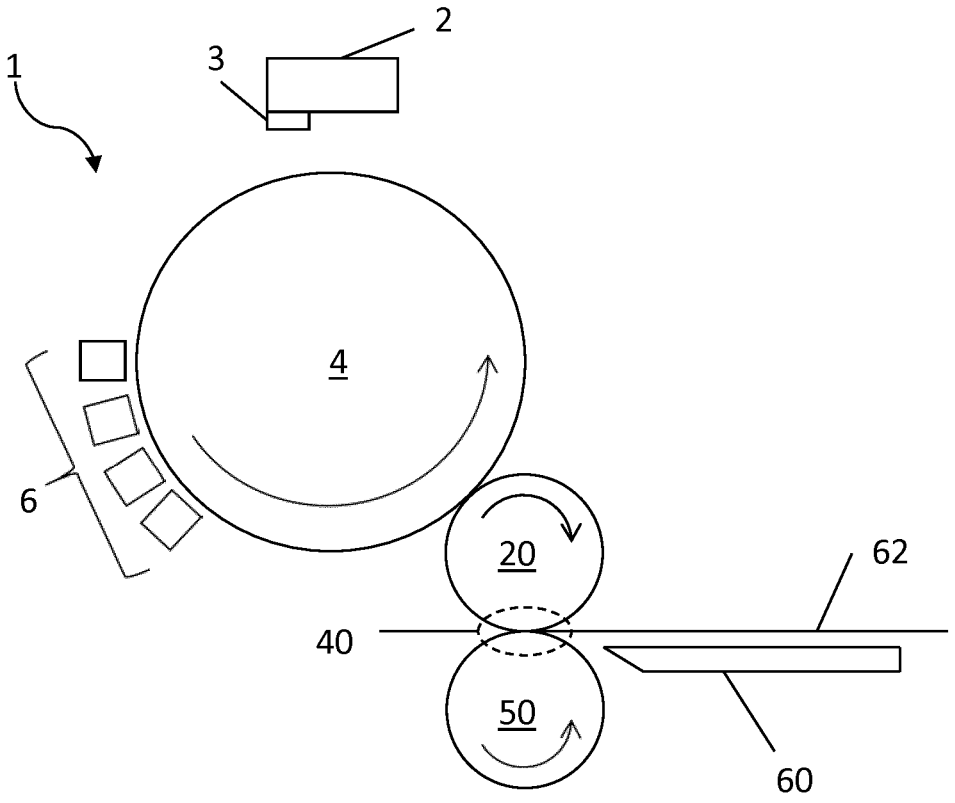
FIG. 1 is a schematic illustration of a liquid electrostatic printing apparatus which may be used in the method described herein.

Before the methods and related aspects of the disclosure are disclosed and described, it is to be understood that this disclosure is not restricted to the particular method features and materials disclosed herein because such method features and materials may vary somewhat. It is also to be understood that the terminology used herein is used for the purpose of describing particular examples. The terms are not intended to be limiting because the scope is intended to be limited by the appended claims and equivalents thereof.

It is noted that, as used in this specification and the appended claims, the singular forms "a," "an," and "the" include plural referents unless the context clearly dictates otherwise.

As used herein, "liquid carrier", "carrier liquid", "carrier," or "carrier vehicle" refers to the fluid in which a resin, pigment, charge directors and/or other additives can be dispersed to form a liquid electrostatic ink or electrophotographic ink. Liquid carriers can include a mixture of a variety of different agents, such as surfactants, co-solvents, viscosity modifiers, and/or other possible ingredients.

As used herein, "electrostatic ink composition" generally refers to an ink composition, which may be in liquid form, generally suitable for use in an electrostatic printing process, sometimes termed an electrophotographic printing process. The electrostatic ink composition may include chargeable particles of the resin and the pigment dispersed in a liquid carrier, which may be as described herein.

As used herein, "co-polymer" refers to a polymer that is polymerized from at least two monomers.

As used herein, "melt flow rate" generally refers to the extrusion rate of a resin through an orifice of defined dimensions at a specified temperature and load, usually reported as temperature/load, e.g. 190° C./2.16 kg. Flow rates can be used to differentiate grades or provide a measure of degradation of a material as a result of molding. In the present disclosure, "melt flow rate" is measured per ASTM D1238-04c Standard Test Method for Melt Flow Rates of Thermoplastics by Extrusion Plastometer. If a melt flow rate of a particular polymer is specified, unless otherwise stated, it is the melt flow rate for that polymer alone, in the absence of any of the other components of the electrostatic composition.

As used herein, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used herein, "melt viscosity" generally refers to the ratio of shear stress to shear rate at a given shear stress or shear rate. Testing is generally performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity @ 140° C., units are mPa-s or cPoise. In some examples, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate. If the melt viscosity of a particular polymer is specified, unless otherwise stated, it is the melt viscosity for that polymer alone, in the absence of any of the other components of the electrostatic composition.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic(ally) printing" or "electrophotographic(ally) printing" generally refers to the process that provides an image that is transferred from a photo imaging substrate or plate either directly or indirectly via an intermediate transfer member to a print substrate, e.g. a paper substrate. As such, the image is not substantially absorbed into the photo imaging substrate or plate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid ink is employed in the electrophotographic process rather than a powder toner. An electrostatic printing process may involve subjecting the electrophotographic ink composition to an electric field, e.g. an electric field having a field strength of 1000 V/cm or more, in some examples 1000 V/mm or more.

As used herein, the term "about" is used to provide flexibility to a numerical range endpoint by providing that a given value may be a little above or a little below the endpoint. The degree of flexibility of this term can be dictated by the particular variable.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not just the numerical values explicitly recited as the end points of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

As used herein, unless specified otherwise, wt % values are to be taken as referring to a weight-for-weight (w/w) percentage of solids in the ink composition, and not including the weight of any carrier fluid present.

Unless otherwise stated, any feature described herein can be combined with any aspect or any other feature described herein.

Multi-colour images can be liquid electrostatically printing using two different liquid electrostatic printing modes. Both printing modes involve the generation of multiple separations (i.e., single colour partial images) that, when superimposed, result in the desired print image. Each of the images is separately generated on a photoconductive surface, transferred to the intermediate transfer member and then to the print substrate. In a so called "multi-shot" printing mode, the images are separately transferred from the intermediate transfer member to the final substrate. In multi-shot printing mode, the images on the intermediate transfer member are each transferred in turn to, and are superimposed, in registration, on the print substrate. In other printing modes, referred to herein as "one-shot" printing modes, the images are separately formed on the photoconductive surface and are transferred in turn to the intermediate transfer member in registration and superposition thereon, to form a print image (i.e. a multi-layered developed ink image). The superposed images in the form of a print image (i.e. a multi-layered developed ink image) are then transferred together to the print substrate.

In some one-shot systems and methods (e.g. liquid electrostatic printing apparatuses operated in one-shot printing mode), the same photoconductive surface is used to generate the separations sequentially. In other systems and methods a plurality of photoconductive surfaces are present, each of which may generate an image of a different colour, the plurality of images being superimposed on the intermediate transfer member.

The present inventors have found that images printed in one-shot mode are more susceptible to adhesion problems than images printed in multi-shot mode. The inventors have surprisingly found that the method described herein can be used to improve the adhesion of images printed on a print substrate in one-shot mode. The present inventors have also found that the method described herein improves the adhesion of images printed on a print substrate in multi-shot mode. The method described herein provides the additional advantage as being useful to improve the adhesion of images to print substrates in duplex printing, for example compared to application of an adhesion promoter to a print substrate in-line with a printing process.

Herein is described a liquid electrostatic printing method comprising providing a liquid electrostatic ink composition comprising a carrier liquid and chargeable particles comprising a resin; and providing an adhesion promoting composition comprising an adhesion promoter. The liquid electrostatic ink composition is contacted with a latent electrostatic image disposed on a surface to create a developed ink image. The developed ink image is transferred to an intermediate transfer member. The adhesion promoting composition is deposited on the intermediate transfer member to form an adhesion promoting layer. The adhesion promoting layer and the developed ink image are transferred to a print substrate (e.g. together or separately), such that the adhesion promoting layer is disposed on the print substrate and the developed ink image is disposed on the adhesion promoting layer.

In an aspect, the present invention provides a liquid electrostatic printing method. The method may comprise:

providing a liquid electrostatic ink composition comprising a carrier liquid and chargeable particles comprising a resin;

providing an adhesion promoting composition comprising an adhesion promoter;

contacting the liquid electrostatic ink composition with a latent electrostatic image disposed on a surface to create a developed ink image;

transferring the developed ink image to an intermediate transfer member;

depositing the adhesion promoting composition on the intermediate transfer member to form an adhesion promoting layer;

transferring the adhesion promoting layer to a print substrate; and transferring the developed ink image to the print substrate, such that the adhesion promoting layer is disposed on the print substrate and the developed ink image is disposed on the adhesion promoting layer.

Liquid Electrostatic Ink Composition

The liquid electrostatic inks (or LEP inks) referred to herein may comprise a carrier liquid and chargeable particles comprising a resin. In some examples, the liquid electrostatic inks may comprise a colourant and a thermoplastic resin dispersed in a carrier liquid. In some examples, the thermoplastic resin may comprise a copolymer of an alkylene monomer and a monomer selected from acrylic acid and methacrylic acid. In some examples, the thermoplastic resin may comprise an ethylene acrylic acid resin, an ethylene methacrylic acid resin or combinations thereof. In some examples, the electrostatic ink also comprises a charge director and/or a charge adjuvant. In some examples, the liquid electrostatic inks described herein may be ElectroInk® and any other Liquid Electro Photographic (LEP) inks (or liquid electrostatic inks) developed by Hewlett-Packard Company.

Resin

The electrostatic ink composition includes chargeable particles comprising a resin. The resin may be a thermoplastic resin. A thermoplastic polymer is sometimes referred to as a thermoplastic resin. The resin may coat a colourant/pigment. In some examples, the resin coats a pigment/colorant such that particles are formed having a core of pigment/colourant and an outer layer of resin thereon. The outer layer of resin may coat the pigment/colourant partially or completely.

In some examples, the electrostatic ink composition may comprise chargeable ink particles comprising a pigment and a resin.

The resin typically includes a polymer. In some examples, the polymer of the resin may be selected from ethylene acrylic acid copolymers; ethylene methacrylic acid copolymers; ethylene vinyl acetate copolymers; copolymers of ethylene (e.g. 80 wt % to 99.9 wt %), and alkyl (e.g. C1 to C5) ester of methacrylic or acrylic acid (e.g. 0.1 wt % to 20 wt %); copolymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g. copolymer of acrylic or methacrylic acid and at least one alkyl ester of acrylic or methacrylic acid wherein alkyl is, in some examples, from 1 to about 20 carbon atoms, such as methyl methacrylate (e.g. 50 wt % to 90 wt %)/methacrylic acid (e.g. 0 wt % to 20 wt %)/ethylhexylacrylate (e.g. 10 wt % to 50 wt %)); ethylene-acrylate terpolymers:ethylene-acrylic esters-maleic anhydride (MAH) or glycidyl methacrylate (GMA) terpolymers; ethylene-acrylic acid ionomers and combinations thereof.

In some examples, the polymer is a copolymer of an alkylene monomer and a monomer having an acid side group. In some examples the alkylene monomer is an ethylene or a propylene monomer. In some examples, the monomer having an acid side group is an acrylic acid monomer or a methacrylic acid monomer. In some examples, the electrostatic ink composition comprises a polymer resin comprising a copolymer of an alkylene monomer and a monomer selected from acrylic acid and methacrylic acid.

The resin may comprise a polymer having acidic side groups. The polymer having acidic side groups may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures, for example using the procedure described in ASTM D1386.

The resin may comprise a polymer, in some examples a polymer having acidic side groups, that has a melt flow rate of less than about 60 g/10 minutes, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers having acidic side groups and/or ester groups in the particles each individually have a melt flow rate of less than 90 g/10 minutes, 80 g/10 minutes or less, in some examples 80 g/10 minutes or less, in some examples 70 g/10 minutes or less, in some examples 70 g/10 minutes or less, in some examples 60 g/10 minutes or less.

The polymer having acidic side groups can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of in some examples about 50 g/10 minutes to about 120 g/10 minutes, in some examples 60 g/10 minutes to about 100 g/10 minutes.

In some examples, the polymer having acid side groups has a melt flow rate of greater than about 120 g/10 minutes, in some examples greater than about 200 g/10 minutes, in some examples greater than about 300 g/10 minutes, in some examples greater than about 400 g/10 minutes. In some examples, the polymer having acid side groups has a melt flow rate of about 450 g/10 minutes.

In some examples, the polymer having acid side groups has a melt flow rate of less than about 500 g/10 minutes.

In some examples, the polymer having acid side groups has a melt flow rate in the range of about 150 g/10 minutes to about 600 g/10 minutes. In some examples, the polymer having acid side groups has a melt flow rate in the range of about 200 g/10 minutes to about 500 g/10 minutes.

In some examples, the polymer having acid side groups constitutes at least 50 wt. % of the resin, in some examples at least 60 wt. % in some examples at least 80 wt. %, in some examples at least 90 wt. %. In some examples, the polymer having acid side groups has a melt flow rate of greater than about 200 g/10 minutes, in some examples a melt flow rate of greater than about 200 g/10 minutes and up to about 500 g/10 minutes, and constitutes at least 50 wt. % of the resin, in some examples at least 60 wt. % in some examples at least 80 wt. %, in some examples at least 90 wt. %.

The melt flow rate can be measured using standard procedures, for example as described in ASTM D1238.

The acidic side groups may be in free acid form or may be in the form of an anion and associated with one or more counterions, generally metal counterions, e.g. a metal selected from the alkali metals, such as lithium, sodium and potassium, alkali earth metals, such as magnesium or calcium, and transition metals, such as zinc. The polymer having acidic sides groups can be selected from resins such as copolymers of ethylene and an ethylenically unsaturated acid of either acrylic acid or methacrylic acid; and ionomers thereof, such as methacrylic acid and ethylene-acrylic or methacrylic acid copolymers which are at least partially neutralized with metal ions (e.g. Zn, Na, Li) such as SURLYN® ionomers. The polymer comprising acidic side groups can be a copolymer of ethylene and an ethylenically unsaturated acid of either acrylic or methacrylic acid, where the ethylenically unsaturated acid of either acrylic or methacrylic acid constitute from 5 wt % to about 25 wt % of the copolymer, in some examples from 10 wt % to about 20 wt % of the copolymer.

The resin may comprise two different polymers having acidic side groups. The two polymers having acidic side groups may have different acidities, which may fall within the ranges mentioned above. The resin may comprise a first polymer having acidic side groups that has an acidity of from 50 mg KOH/g to 110 mg KOH/g and a second polymer having acidic side groups that has an acidity of 110 mg KOH/g to 130 mg KOH/g.

The resin may comprise two different polymers having acidic side groups: a first polymer having acidic side groups that has a melt flow rate of about 10 g/10 minutes to about 50 g/10 minutes and an acidity of from 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

The resin may comprise two different polymers having acidic side groups: a first polymer that is a copolymer of ethylene (e.g. 92 to 85 wt %, in some examples about 89 wt %) and acrylic or methacrylic acid (e.g. 8 to 15 wt %, in some examples about 11 wt %) having a melt flow rate of 80 to 110 g/10 minutes and a second polymer that is a copolymer of ethylene (e.g. about 80 to 92 wt %, in some examples about 85 wt %) and acrylic acid (e.g. about 18 to 12 wt %, in some examples about 15 wt %), having a melt viscosity lower than that of the first polymer, the second polymer for example having a melt viscosity of 15000 poise or less, in some examples a melt viscosity of 10000 poise or less, in some examples 1000 poise or less, in some examples 100 poise or less, in some examples 50 poise or less, in some examples 10 poise or less. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

In any of the resins mentioned above, the ratio of the first polymer having acidic side groups to the second polymer having acidic side groups can be from about 10:1 to about 2:1. In another example, the ratio can be from about 6:1 to about 3:1, in some examples about 4:1.

The resin may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described herein. The resin may comprise a first polymer having a melt viscosity of 15000 poise or more, in some examples 20000 poise or more, in some examples 50000 poise or more, in some examples 70000 poise or more; and in some examples, the resin may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is Nucrel 960 (from DuPont), and an example of the second polymer is Nucrel 699 (from DuPont), and an example of the third polymer is AC-5120 (from Honeywell). The first, second and third polymers may be polymers having acidic side groups as described herein. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

If the resin comprises a single type of resin polymer, the resin polymer (excluding any other components of the electrostatic ink composition) may have a melt viscosity of 6000 poise or more, in some examples a melt viscosity of 8000 poise or more, in some examples a melt viscosity of 10000 poise or more, in some examples a melt viscosity of 12000 poise or more. If the resin comprises a plurality of polymers all the polymers of the resin may together form a mixture (excluding any other components of the electrostatic ink composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

The resin may comprise two different polymers having acidic side groups that are selected from copolymers of ethylene and an ethylenically unsaturated acid of either methacrylic acid or acrylic acid; and ionomers thereof, such as methacrylic acid and ethylene-acrylic or methacrylic acid copolymers which are at least partially neutralized with metal ions (e.g. Zn, Na, Li) such as SURLYN® ionomers. The resin may comprise (i) a first polymer that is a copolymer of ethylene and an ethylenically unsaturated acid of either acrylic acid and methacrylic acid, wherein the ethylenically unsaturated acid of either acrylic or methacrylic acid constitutes from 8 wt % to about 16 wt % of the copolymer, in some examples 10 wt % to 16 wt % of the copolymer; and (ii) a second polymer that is a copolymer of ethylene and an ethylenically unsaturated acid of either acrylic acid and methacrylic acid, wherein the ethylenically unsaturated acid of either acrylic or methacrylic acid constitutes from 12 wt % to about 30 wt % of the copolymer, in some examples from 14 wt % to about 20 wt % of the copolymer, in some examples from 16 wt % to about 20 wt % of the copolymer in some examples from 17 wt % to 19 wt % of the copolymer.

In some examples, the resin essentially consists of a copolymer of ethylene and methacrylic acid. In some examples the methacrylic acid of the copolymer of ethylene and methacrylic acid constitutes about 8 wt % to about 12 wt % of the copolymer, in some examples about 9 wt % to about 11 wt % of the copolymer, in some examples about 10 wt. % of the copolymer.

In an example, the resin constitutes about 5 to 90%, in some examples about 5 to 80%, by weight of the solids of the electrostatic ink composition. In another example, the resin constitutes about 10 to 60% by weight of the solids of the electrostatic ink composition. In another example, the resin constitutes about 15 to 40% by weight of the solids of the electrostatic ink composition. In another example, the resin constitutes about 60 to 95% by weight, in some examples from 80 to 90% by weight, of the solids of the electrostatic ink composition.

The resin may comprise a polymer having acidic side groups, as described above (which may be free of ester side groups), and a polymer having ester side groups. The polymer having ester side groups is, in some examples, a thermoplastic polymer. The polymer having ester side groups may further comprise acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, for example, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, in some examples 1 to 10 carbons; in some examples selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute 1 to 50% by weight of the co-polymer, in some examples 5 to 40% by weight, in some examples 5 to 20% by weight of the copolymer, in some examples 5 to 15% by weight of the copolymer. The second monomer may constitute 1 to 50% by weight of the co-polymer, in some examples 5 to 40% by weight of the co-polymer, in some examples 5 to 20% by weight of the co-polymer, in some examples 5 to 15% by weight of the copolymer. In an example, the first monomer constitutes 5 to 40% by weight of the co-polymer, the second monomer constitutes 5 to 40% by weight of the co-polymer, and with the third monomer constituting the remaining weight of the copolymer. In an example, the first monomer constitutes 5 to 15% by weight of the co-polymer, the second monomer constitutes 5 to 15% by weight of the co-polymer, with the third monomer constituting the remaining weight of the copolymer. In an example, the first monomer constitutes 8 to 12% by weight of the co-polymer, the second monomer constitutes 8 to 12% by weight of the co-polymer, with the third monomer constituting the remaining weight of the copolymer. In an example, the first monomer constitutes about 10% by weight of the co-polymer, the second monomer constitutes about 10% by weight of the co-polymer, and with the third monomer constituting the remaining weight of the copolymer. The polymer having ester side groups may be selected from the Bynel® class of monomer, including Bynel 2022 and Bynel 2002, which are available from DuPont®.

The polymer having ester side groups may constitute 1% or more by weight of the total amount of the resin polymers in the resin, e.g. the total amount of the polymer or polymers having acidic side groups and polymer having ester side groups. The polymer having ester side groups may constitute 5% or more by weight of the total amount of the resin polymers in the resin, in some examples 8% or more by weight of the total amount of the resin polymers in the resin, in some examples 10% or more by weight of the total amount of the resin polymers in the resin, in some examples 15% or more by weight of the total amount of the resin polymers in the resin, in some examples 20% or more by weight of the total amount of the resin polymers in the resin, in some examples 25% or more by weight of the total amount of the resin polymers in the resin, in some examples 30% or more by weight of the total amount of the resin polymers in the resin, in some examples 35% or more by weight of the total amount of the resin polymers in the resin. The polymer having ester side groups may constitute from 5% to 50% by weight of the total amount of the resin polymers in the resin, in some examples 10% to 40% by weight of the total amount of the resin polymers in the resin, in some examples 15% to 30% by weight of the total amount of the polymers in the resin.

The polymer having ester side groups may have an acidity of 50 mg KOH/g or more, in some examples an acidity of 60 mg KOH/g or more, in some examples an acidity of 70 mg KOH/g or more, in some examples an acidity of 80 mg KOH/g or more. The polymer having ester side groups may have an acidity of 100 mg KOH/g or less, in some examples 90 mg KOH/g or less. The polymer having ester side groups may have an acidity of 60 mg KOH/g to 90 mg KOH/g, in some examples 70 mg KOH/g to 80 mg KOH/g.

The polymer having ester side groups may have a melt flow rate of about 10 g/10 minutes to about 120 g/10 minutes, in some examples about 10 g/10 minutes to about 50 g/10 minutes, in some examples about 20 g/10 minutes to about 40 g/10 minutes, in some examples about 25 g/10 minutes to about 35 g/10 minutes.

In an example, the polymer or polymers of the resin can be selected from the Nucrel family of toners (e.g. Nucrel 403™, Nucrel 407™ Nucrel 609HS™, Nucrel 908HS™, Nucrel 1202HC™, Nucrel 30707™ Nucrel 1214™, Nucrel 903™, Nucrel 3990™ Nucrel 910™, Nucrel 925™, Nucrel 699™, Nucrel 599™, Nucrel 960™, Nucrel RX 76™, Nucrel 2806™, Bynell 2002, Bynell 2014, and Bynell 2020 (sold by E. I. du PONT)), the Aclyn family of toners (e.g. Aaclyn 201, Aclyn 246, Aclyn 285, and Aclyn 295), and the Lotader family of toners (e.g. Lotader 2210, Lotader, 3430, and Lotader 8200 (sold by Arkema)).

In some examples, the colorant constitutes a certain wt %, e.g. from 1 wt %, to 60 wt % of the solids of the electrostatic ink composition, and the remaining wt % of the solids of the electrostatic ink composition is formed by the resin and, in some examples, any other additives that are present. The other additives may constitute 10 wt % or less of the solids of the electrostatic ink composition, in some examples 5 wt % or less of the solids of the electrostatic ink composition, in some examples 3 wt % or less of the solids of the electrostatic ink composition. In some examples, the resin may constitute 5% to 99% by weight of the solids in the electrostatic ink composition, in some examples 50% to 90% by weight of the solids of the electrostatic ink composition, in some examples 70% to 90% by weight of the solids of the electrostatic ink composition. The remaining wt % of the solids in the ink composition may be a colorant and, in some examples, any other additives that may be present.

Colourant

The liquid electrostatic ink may include a colourant. The colorant may be a dye or pigment. The colorant can be any colorant compatible with the liquid carrier and useful for electrophotographic printing. For example, the colorant may be present as pigment particles, or may comprise a resin (in addition to the polymers described herein) and a pigment. The resins and pigments can be any of those standardly used in the art. In some examples, the colorant is selected from a cyan pigment, a magenta pigment, a yellow pigment and a black pigment. For example, pigments by Hoechst including Permanent Yellow DHG, Permanent Yellow GR, Permanent Yellow G, Permanent Yellow NCG-71, Permanent Yellow GG, Hansa Yellow RA, Hansa Brilliant Yellow 5GX-02, Hansa Yellow X, NOVAPERM® YELLOW HR, NOVAPERM® YELLOW FGL, Hansa Brilliant Yellow 10GX, Permanent Yellow G3R-01, HOSTAPERM® YELLOW H4G, HOSTAPERM® YELLOW H3G, HOSTAPERM® ORANGE GR, HOSTAPERM® SCARLET GO, Permanent Rubine F6B; pigments by Sun Chemical including L74-1357 Yellow, L75-1331 Yellow, L75-2337 Yellow; pigments by Heubach including DALAMAR® YELLOW YT-858-D; pigments by Ciba-Geigy including CROMOPHTHAL® YELLOW 3 G, CROMOPHTHAL® YELLOW GR, CROMOPHTHAL® YELLOW 8 G, IRGAZINE® YELLOW 5GT, IRGALITE® RUBINE 4BL, MONASTRAL® MAGENTA, MONASTRAL® SCARLET, MONASTRAL® VIOLET, MONASTRAL® RED, MONASTRAL® VIOLET; pigments by BASF including LUMOGEN® LIGHT YELLOW, PALIOGEN® ORANGE, HELIOGEN® BLUE L 690 IF, HELIOGEN® BLUE TBD 7010, HELIOGEN® BLUE K 7090, HELIOGEN® BLUE L 710 IF, HELIOGEN® BLUE L 6470, HELIOGEN® GREEN K 8683, HELIOGEN® GREEN L 9140; pigments by Mobay including QUINDO® MAGENTA, INDOFAST® BRILLIANT SCARLET, QUINDO® RED 6700, QUINDO® RED 6713, INDOFAST® VIOLET; pigments by Cabot including Maroon B STERLING® NS BLACK, STERLING® NSX 76, MOGUL® L; pigments by DuPont including TIPURE® R-101; and pigments by Paul Uhlich including UHLICH® BK 8200.

The colorant or pigment particle may be present in the LEP ink composition in an amount of from 10 wt % to 80 wt % of the total amount of resin and pigment, in some examples 15 wt % to 80 wt %, in some examples 15 wt % to 60 wt %, in some examples 15 wt % to 50 wt %, in some examples 15 wt % to 40 wt %, in some examples 15 wt % to 30 wt % of the total amount of resin and colorant. In some examples, the colorant or pigment particle may be present in the LEP ink in an amount of at least 50 wt % of the total amount of resin and colorant or pigment, for example at least 55 wt % of the total amount of resin and colorant or pigment.

Carrier Liquid

The liquid electrostatic ink composition includes a liquid carrier. In some examples, the liquid electrostatic ink composition comprises chargeable particles including the resin which may be dispersed in the liquid carrier. The liquid carrier can include or be a hydrocarbon, silicone oil, vegetable oil, etc. The liquid carrier can include, for example, an insulating, non-polar, non-aqueous liquid that can be used as a medium for ink particles, i.e. the ink particles including the resin and, in some examples, a pigment. The liquid carrier can include compounds that have a resistivity in excess of about $10^9$ ohm·cm. The liquid carrier may have a dielectric constant below about 5, in some examples below about 3. The liquid carrier can include hydrocarbons. The hydrocarbon can include, for example, an aliphatic hydrocarbon, an isomerized aliphatic hydrocarbon, branched chain aliphatic hydrocarbons, aromatic hydrocarbons, and combinations thereof. Examples of the liquid carriers include, for example, aliphatic hydrocarbons, isoparaffinic compounds, paraffinic compounds, dearomatized hydrocarbon compounds, and the like. In particular, the liquid carriers can include, for example, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

The liquid carrier can constitute about 20% to 99.5% by weight of the electrostatic ink composition, in some examples 50% to 99.5% by weight of the electrostatic ink composition. The liquid carrier may constitute about 40 to 90% by weight of the electrostatic ink composition. The liquid carrier may constitute about 60% to 80% by weight of the electrostatic ink composition. The liquid carrier may constitute about 90% to 99.5% by weight of the electrostatic ink composition, in some examples 95% to 99% by weight of the electrostatic ink composition.

The liquid electrostatic ink composition, when printed on a print substrate, may be substantially free from liquid carrier. In an electrostatic printing process and/or afterwards, the liquid carrier may be removed, e.g. by an electrophoresis processes during printing and/or evaporation, such that substantially just solids are transferred to the print substrate. Substantially free from liquid carrier may indicate that the ink printed on the print substrate contains less than 5 wt % liquid carrier, in some examples, less than 2 wt % liquid carrier, in some examples less than 1 wt % liquid carrier, in some examples less than 0.5 wt % liquid carrier. In some examples, the ink printed on the print substrate is free from liquid carrier.

Charge Director

In some examples, the liquid electrostatic ink composition includes a charge director. The charge director may be added to an electrostatic ink composition in order to impart and/or maintain sufficient electrostatic charge on the chargeable resin particles or ink particles. In some examples, the charge director may comprise ionic compounds, particularly metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director can be selected from, but is not limited to, oil-soluble petroleum sulfonates (e.g. neutral Calcium Petronate™, neutral Barium Petronate™, and basic Barium Petronate™), polybutylene succinimides (e.g. OLOA™ 1200 and Amoco 575), and glyceride salts (e.g.

sodium salts of phosphated mono- and diglycerides with unsaturated and saturated acid substituents), sulfonic acid salts including, but not limited to, barium, sodium, calcium, and aluminum salts of sulfonic acid. The sulfonic acids may include, but are not limited to, alkyl sulfonic acids, aryl sulfonic acids, and sulfonic acids of alkyl succinates. The charge director can impart a negative charge or a positive charge on the resin-containing particles of an electrostatic ink composition.

The charge director may be added in order to impart and/or maintain sufficient electrostatic charge on the chargeable resin particles or ink particles, which may be particles comprising the thermoplastic resin.

In some examples, the electrostatic ink composition comprises a charge director comprising a simple salt. The ions constructing the simple salts are all hydrophilic. The simple salt may include a cation selected from the group consisting of Mg, Ca, Ba, $NH_4$, tert-butyl ammonium, $Li^+$, and $Al^{+3}$, or from any sub-group thereof. The simple salt may include an anion selected from the group consisting of $SO_4^{2-}$, $PO^{3-}$, $NO^{3-}$, $HPO_4^{2-}$, $CO_3^{2-}$, acetate, trifluoroacetate (TFA), $Cl^-$, $BF_4^-$, $F^-$, $ClO_4^-$, and $TiO_3^{4-}$ or from any sub-group thereof. The simple salt may be selected from $CaCO_3$, $Ba_2TiO_3$, $Al_2(SO_4)$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof.

In some examples, the electrostatic ink composition comprises a charge director comprising a sulfosuccinate salt of the general formula $MA_n$, wherein M is a metal, n is the valence of M, and A is an ion of the general formula (I): $[R^1—O—C(O)CH_2CH(SO_3^-)C(O)—O—R^2]$, wherein each of $R^1$ and $R^2$ is an alkyl group. In some examples each of $R_1$ and $R_2$ is an aliphatic alkyl group. In some examples, each of $R_1$ and $R_2$ independently is a C6-25 alkyl. In some examples, said aliphatic alkyl group is linear. In some examples, said aliphatic alkyl group is branched. In some examples, said aliphatic alkyl group includes a linear chain of more than 6 carbon atoms. In some examples, $R_1$ and $R_2$ are the same. In some examples, at least one of $R_1$ and $R_2$ is $C_{13}H_{27}$. In some examples, M is Na, K, Cs, Ca, or Ba.

In some examples, the charge director comprises at least one micelle forming salt and nanoparticles of a simple salt as described above. The simple salts are salts that do not form micelles by themselves, although they may form a core for micelles with a micelle forming salt. The sulfosuccinate salt of the general formula $MA_n$ is an example of a micelle forming salt. The charge director may be substantially free of an acid of the general formula HA, where A is as described above. The charge director may include micelles of said sulfosuccinate salt enclosing at least some of the nanoparticles of the simple salt. The charge director may include at least some nanoparticles of the simple salt having a size of 200 nm or less, and/or in some examples 2 nm or more.

The charge director may include one of, some of or all of (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and can be obtained, for example, from Chemtura. An example isopropyl amine sulphonate salt is dodecyl benzene sulfonic acid isopropyl amine, which is available from Croda.

In some examples, the charge director constitutes about 0.001% to 20%, in some examples 0.01% to 20% by weight, in some examples 0.01 to 10% by weight, in some examples 0.01% to 1% by weight of the solids of an electrostatic ink composition. In some examples, the charge director constitutes about 0.001% to 0.15% by weight of the solids of the electrostatic ink composition, in some examples 0.001% to 0.15%, in some examples 0.001% to 0.02% by weight of the solids of an electrostatic ink composition, in some examples 0.1% to 2% by weight of the solids of the electrostatic ink composition, in some examples 0.2% to 1.5% by weight of the solids of the electrostatic ink composition in some examples 0.1% to 1% by weight of the solids of the electrostatic ink composition, in some examples 0.2% to 0.8% by weight of the solids of the electrostatic ink composition.

In some examples, the charge director is present in an amount of from 3 mg/g to 20 mg/g, in some examples from 3 mg/g to 15 mg/g, in some examples from 10 mg/g to 15 mg/g, in some examples from 5 mg/g to 10 mg/g (where mg/g indicates mg per gram of solids of the electrostatic ink composition).

Other Additives

The liquid electrostatic ink composition may include another additive or a plurality of other additives. The other additive or plurality of other additives may be added at any stage of the method. The other additive or plurality of other additives may be selected from a charge adjuvant, a wax, a surfactant, viscosity modifiers, and compatibility additives. The wax may be an incompatible wax. As used herein, "incompatible wax" may refer to a wax that is incompatible with the resin. Specifically, the wax phase separates from the resin phase upon the cooling of the resin fused mixture on a print substrate during and after the transfer of the ink film to the print substrate, e.g. from an intermediate transfer member, which may be a heated blanket.

In some examples, the electrostatic ink composition includes a charge adjuvant. A charge adjuvant may promote charging of the particles when a charge director is present. The method as described herein may involve adding a charge adjuvant at any stage. The charge adjuvant can include, for example, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Zn salts of stearic acid, Cu salts of stearic acid, Pb salts of stearic acid, Fe salts of stearic acid, metal carboxylates (e.g., Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock copolymers of 2-ethylhexyl methacrylate-co-methacrylic acid calcium and ammonium salts, copolymers of an alkyl acrylamidoglycolate alkyl ether (e.g., methyl acrylamidoglycolate methyl ether-co-vinyl acetate), and hydroxy bis(3,5-di-tert-butyl salicylic) aluminate monohydrate. In an example, the charge adjuvant is or includes aluminum di- or tristearate. In some examples, the charge adjuvant is VCA (an aluminium stearate available from Sigma Aldrich).

The charge adjuvant may be present in an amount of about 0.1 to 5% by weight, in some examples about 0.1 to 1% by weight, in some examples about 0.3 to 0.8% by weight of the solids of the electrostatic ink composition, in some examples about 1 wt % to 3 wt % of the solids of the electrostatic ink composition, in some examples about 1.5 wt % to 2.5 wt % of the solids of the electrostatic ink composition.

The charge adjuvant may be present in an amount of less than 5.0% by weight of total solids of the electrostatic ink composition, in some examples in an amount of less than 4.5% by weight, in some examples in an amount of less than 4.0% by weight, in some examples in an amount of less than 3.5% by weight, in some examples in an amount of less than 3.0% by weight, in some examples in an amount of less than 2.5% by weight, in some examples about 2.0% or less by weight of the solids of the electrostatic ink composition.

In some examples, the liquid electrostatic ink composition further includes, e.g. as a charge adjuvant, a salt of multivalent cation and a fatty acid anion. The salt of multivalent cation and a fatty acid anion can act as a charge adjuvant. The multivalent cation may, in some examples, be a divalent or a trivalent cation. In some examples, the multivalent cation is selected from Group 2, transition metals and Group 3 and Group 4 in the Periodic Table. In some examples, the multivalent cation includes a metal selected from Ca, Sc, Ti, V, Cr, Mn, Fe, Co, Ni, Cu, Zn, Al and Pb. In some examples, the multivalent cation is $Al^{3+}$. The fatty acid anion may be selected from a saturated or unsaturated fatty acid anion. The fatty acid anion may be selected from a $C_8$ to $C_{28}$ fatty acid anion, in some examples a $C_{14}$ to $C_{22}$ fatty acid anion, in some examples a Cm to $C_{20}$ fatty acid anion, in some examples a $C_{17}$, $C_{18}$ or $C_{10}$ fatty acid anion. In some examples, the fatty acid anion is selected from a caprylic acid anion, capric acid anion, lauric acid anion, myristic acid anion, palmitic acid anion, stearic acid anion, arachidic acid anion, behenic acid anion and cerotic acid anion.

The charge adjuvant, which may, for example, be or include a salt of a multivalent cation and a fatty acid anion, may be present in an amount of 0.1 wt % to 5 wt % of the solids of the electrostatic ink composition, in some examples in an amount of 0.1 wt % to 2 wt % of the solids of the electrostatic ink composition, in some examples in an amount of 0.1 wt % to 2 wt % of the solids of the electrostatic ink composition, in some examples in an amount of 0.3 wt % to 1.5 wt % of the solids of the electrostatic ink composition, in some examples about 0.5 wt % to 1.2 wt % of the solids of the electrostatic ink composition, in some examples about 0.8 wt % to 1 wt % of the solids of the electrostatic ink composition, in some examples about 1 wt % to 3 wt % of the solids of the electrostatic ink composition, in some examples about 1.5 wt % to 2.5 wt % of the solids of the electrostatic ink composition.

Adhesion Promoting Composition

The adhesion promoting composition comprises an adhesion promoter.

Adhesion Promoter

In some examples the adhesion promoter has a relatively low molecular weight, for example the adhesion promoter may comprise a polymer that has a relatively low molecular weight. For example, the number average molecular weight Mn may be less than about 5000, for example less than about 4000, less than about 3000, less than about 2000, less than about 1500, or less than about 1000. In some examples, the number average molecular weight Mn may be between about 200 and about 5000, for example between about 300 and about 3000, between about 400 and about 2000, between about 400 and about 1500, between about 400 and about 1000, or between about 600 and about 1000.

The adhesion promoter described herein may have a softening temperature that is above room temperature. The softening temperature may be sufficient to allow the adhesion promoter to be soft and flow on the blanket, for example to allow for the possibility of film forming. For example, the softening temperature of the adhesion promoter may be between about 50° C. and about 300° C., e.g., between about 60° C. and about 250° C., between about 70° C. and about 200° C., between about 80° C. and about 150° C., between about 90° C. and about 120° C., or between about 90° C. and about 150° C. In some examples, the softening temperature of the tackifier is about 100° C. The softening temperature of the adhesion promoter described herein may be the ring and ball softening temperature as determined according to ASTM E 28. The softening temperature of the tackifier described herein may be the ring and ball softening temperature as determined according to ASTM D 6493.

The adhesion promoting composition may comprise at least about 1 wt. % adhesion promoter by total weight of the adhesion promoting composition, for example at least about 2 wt. %, at least about 3 wt. %, at least about 4 wt. % or at least about 5 wt. % adhesion promoter by total weight of the adhesion promoting composition.

The adhesion promoting composition may comprise up to about 50 wt. % adhesion promotor by total weight of the adhesion promoting composition, for example up to about 40 wt. %, up to about 30 wt. %, or up to about 20 wt % adhesion promotor by total weight of the adhesion promoting composition.

In some examples, the adhesion promoting composition comprises from about 1 wt. % to about 50 wt. % adhesion promotor by total weight of the adhesion promoting composition, for example from about 2 wt. % to about 40 wt. %, or from about 3 wt. % to about 30 wt. % adhesion promotor by total weight of the adhesion promoting composition.

In some examples, the adhesion promoter may comprise, consist of, or consist essentially of a tackifier, for example at least one tackifier.

Tackifier

In some examples, tackifiers are chemical compounds that may be employed in formulating adhesives to increase the tack, the stickiness of the surface of the adhesive. Tackifiers may be low-molecular weight compounds with high glass transition temperature. In some examples, at low strain rates tackifiers provide higher stress compliance and become stiffer at higher strain rates. Tackifiers may have a low molecular weight, and a glass transition and a softening temperature above room temperature, providing them with suitable viscoelastic properties.

In some examples the tackifier has a relatively low molecular weight, for example the tackifier may comprise a polymer that has a relatively low molecular weight. For example, the number average molecular weight Mn may be less than about 5000, for example less than about 4000, less than about 3000, less than about 2000, less than about 1500, or less than about 1000. In some examples, the number average molecular weight Mn may be between about 200 and about 5000, for example between about 300 and about 3000, between about 400 and about 2000, between about 400 and about 1500, between about 400 and about 1000, or between about 600 and about 1000.

The tackifier described herein may have a softening temperature that is above room temperature. The softening temperature may be sufficient to allow the tackifier to be soft and flow on the blanket, for example to allow for the possibility of film forming. For example, the softening temperature of the tackifier may be between about 50° C. and about 300° C., e.g., between about 60° C. and about 250° C., between about 70° C. and about 200° C., between about 80° C. and about 150° C., between about 80° C. and about 160° C., between about 90° C. and about 120° C., or between about 90° C. and about 150° C. In some examples, the softening temperature of the tackifier is about 100° C. The softening temperature of the tackifier described herein may be the ring and ball softening temperature as determined according to ASTM E 28. The softening temperature of the tackifier described herein may be the ring and ball softening temperature as determined according to ASTM D 6493.

In some examples, the tackifier has a relatively high polarity. In some examples, the polarity is sufficiently high to achieve repulsion from the blanket and/or better compatibility with the substrate. The polarity of the tackifier may be reflected in the functional group of the polymer thereof. For example, the tackifier may have a polar functional group, such as a polar acid group. Not to be bound by any particular theory, but due at least in part to its polarity, the tackifier described herein may have a relatively high solubility in a non-polar carrier liquid. The carrier liquid may be any of those described herein (e.g., isoparaffin, such as Isopar®). In one example, the tackifier described herein may be dissolved in the non-polar carrier liquid completely. A complete dissolution herein may encompass a minute variation—e.g., at least 95% dissolution, such as 98%, 99%, 99.5%, or higher, dissolution. The percentage may refer to volume or weight, depending on the context.

The tackifier may have any suitable chemistry. For example, the tackifier may comprise, or be, resins. For example, the tackifier may comprise, or be, rosins and their derivatives, terpenes and modified terpenes, aliphatic, cycloaliphatic and aromatic resins (C5 aliphatic resins, C9 aromatic resins, and C5/C9 aliphatic/aromatic resins), hydrogenated hydrocarbon resins, and their mixtures, terpene-phenol resins (TPR, used often with ethylene-vinyl acetate adhesives). In one example, the tackifier comprises hydrocarbon resin, a hydrogenated hydrocarbon resin, an acid rosin, a terpene phenolic resin, a rosin ester, or a polyterpene.

The tackifier may be selected from commercially available products. For example, the tackifier may be of the Regalite™ family and the Dymerex™ family, availably by Eastman Chemical Company, USA. For example, the tackifier may be Regalite™ S 5100, Regalite™ R 1100, etc. In one example, the tackifier comprises, or is, a dimerized acid rosin, such as the Dymerex™ polymerized rosin. For example, the tackifier may be of the Sylvares™ family and the Sylvatac™ family, availably by Arizona Chemical, USA. For example, the tackifier may be Sylvares™ TP-105, Sylvares™ TRB115, Sylvatac™ RE 95, etc. For example, the tackifier may be of the Nures™ family, available by Newport Industries, USA. For example, the tackifier is Nures™ TP100. In one example, TP100 comprises a terpene phenolic resin. Other tackifiers are also possible.

Not to be bound by any particular theory, but the increasing chemistry compatibility of the tackifier to the substrate may enhance image transfer to the substrate and enhance incompatibility of the image to the silicone based releasing surface of the blanket. As a result, this may enhance the transfer of the image from the blanket to the substrate.

Carrier Liquid

The adhesion promoting composition may comprise a carrier liquid. The carrier liquid may be as defined above for the liquid electrostatic ink composition. In some examples, the adhesion promoter, e.g. the tackifier, is dissolved in the carrier liquid of the adhesion promoting composition.

The adhesion promoting composition may comprise at least about 50 wt. % carrier liquid by total weight of the adhesion promoting composition. In some examples, the adhesion promoting composition comprises from about 50 wt. % to about 99 wt. % carrier liquid by total weight of the adhesion promoting composition, for example from about 60 wt. % to about 98 wt. % carrier liquid, or from about 70 wt. % to about 97 wt. % carrier liquid by total weight of the adhesion promoting composition.

In some examples, the adhesion promoting composition has a dynamic viscosity at 20° C. of less than about 50 cP.

Liquid Electrostatic Printing Method

Described herein is a liquid electrostatic printing method comprising:

providing a liquid electrostatic ink composition comprising a carrier liquid and chargeable particles comprising a resin;

providing an adhesion promoting composition comprising an adhesion promoter;

contacting the liquid electrostatic ink composition with a latent electrostatic image disposed on a surface to create a developed ink image;

transferring the developed ink image to an intermediate transfer member;

depositing the adhesion promoting composition on the intermediate transfer member to form an adhesion promoting layer;

transferring the adhesion promoting layer to a print substrate; and transferring the developed ink image to the print substrate, such that the adhesion promoting layer is disposed on the print substrate and the developed ink image is disposed on the adhesion promoting layer.

In some examples, the adhesion promoting composition is deposited on the developed ink image disposed on the intermediate transfer member to form an adhesion promoting layer disposed on the developed ink image and wherein the adhesion promoting layer and the developed ink image are transferred together from the intermediate transfer member to the print substrate.

In some examples, the adhesion promoting composition is deposited on the intermediate transfer member before the developed ink image is transferred to the intermediate transfer member. In such examples, the adhesion promoting composition may be transferred form the ITM to the print substrate before the developed ink image is transferred to the intermediate transfer member.

In some examples, following transfer of the developed ink image and the adhesion promoting layer to the print substrate, such that the adhesion promoting layer is disposed on the print substrate and the developed ink image is disposed on the adhesion promoting layer, a further developed ink image may be formed on the surface on which a latent electrostatic image is formed and subsequently transferred to the ITM and then transferred to the print substrate.

In some examples, a plurality of electrostatic ink compositions are provided, each of the plurality of electrostatic ink compositions are contacted with a latent electrostatic image on the surface to form a developed ink image, and each of the developed ink images are transferred to the ITM before transfer to a print substrate. In some examples, each of the developed ink images are transferred to the ITM such that each of the developed ink images are disposed on the ITM to form a multi-layered developed ink image on the ITM and the adhesion promoting composition is deposited on the multi-layered developed ink image to form an adhesion promoting layer disposed on the multi-layered developed ink image disposed on the ITM, and wherein the adhesion promoting layer and the multi-layered developed ink image are transferred together from the intermediate transfer member to the print substrate.

In some examples, the adhesion promoting composition and the developed ink image composition are deposited on the ITM in one shot mode, i.e. such that the adhesion promoting layer is disposed on the developed ink image on the ITM. In such examples, the adhesion promoting layer and the developed ink image are transferred together from the intermediate transfer member to the print substrate.

In some examples, the adhesion promoting composition and the developed ink image composition are deposited on the ITM in multi-shot mode. In some examples, the adhesion promoting composition is deposited on the ITM to form an adhesion promoting layer disposed on the ITM. The adhesion promoting composition may be transferred to the print substrate before a developed ink image is transferred to the ITM. The developed ink image may then be transferred to the adhesion promoting layer disposed on the print substrate.

FIG. 1 shows a schematic illustration of an example of a liquid electrostatic printing apparatus (LEP printing apparatus) 1. An image, including any combination of graphics, text and images, is communicated to the LEP printing apparatus 1. The LEP includes a photo charging unit 2 and a photo-imaging cylinder 4. The image is initially formed on a photo-conductive member in the form of a photo-imaging cylinder 4 before being transferred the intermediate transfer member (ITM) 20 which may be in the form of a roller (first transfer), and then from the ITM 20 to a print substrate 62 (second transfer).

According to an illustrative example, the initial image is formed on a rotating photo-imaging cylinder 4 by the photo charging unit 2. Firstly, the photo charging unit 2 deposits a uniform static charge on the photo-imaging cylinder 4 and then a laser imaging portion 3 of the photo charging unit 2 dissipates the static charges in selected portions of the image area on the photo-imaging cylinder 4 to leave a latent electrostatic image. The latent electrostatic image is an electrostatic charge pattern representing the image to be printed. Liquid electrostatic ink is then transferred to the photo-imaging cylinder 4 by Binary Ink Developer (BID) units 6. The BID units 6 may comprise a developer roller to which a developer voltage may be applied to charge the chargeable particles of the liquid electrostatic ink composition. The BID units 6 present a uniform film of ink to the photo-imaging cylinder 4. The ink contains electrically charged ink particles which, by virtue of an appropriate potential between the BID units and the electrostatic image areas, are attracted to the latent electrostatic image on the photo-imaging cylinder 4. The ink does not adhere to the uncharged, non-image areas and forms a developed image on the surface of the latent electrostatic image. The photo-imaging cylinder 4 then has a single colour developed ink image on its surface.

The developed ink image is then transferred from the photo-imaging cylinder 4 to the ITM 20 by electrical forces. The image is then dried and fused on ITM 20.

In one-shot mode, a further latent electrostatic image may be created on the photo-imaging cylinder 4 and a different coloured LEP ink may then be transferred to the photo-imaging cylinder 4 by Binary Ink Developer (BID) units 6. The photo-imaging cylinder 4 then has a different single colour developed ink image on its surface. The different single colour developed ink image is then transferred from the photo-imaging cylinder 4 to the ITM 20 by electrical forces. The image is then dried and fused on ITM 20 such that the different single colour developed ink image is disposed on the first single colour developed ink image on the surface of the ITM 20. This process may be repeated to build up a multi-layered developed ink image on the ITM 20, for example a four layered developed ink image containing a cyan developed ink image layer, a magenta developed ink image layer, a black developed ink image layer and a yellow developed ink image layer may be formed on the ITM 20.

In one shot mode, before transfer of the developed ink image, for example the multi-layered developed ink image, from the ITM 20 to a print substrate, the adhesion promoting composition is deposited on the developed ink image disposed on the ITM 20. The adhesion promoting composition may be applied to the ITM (e.g. to the developed ink image disposed on the ITM 20) by any suitable means. For example, a developer roller of a BID unit may be used to apply the adhesion promoting composition to the photo-imaging cylinder 4 (for example in the absence of a developer voltage applied to the developer roller), the adhesion promoting composition may then be transferred from the photo-imaging cylinder to the ITM as the photo-imaging cylinder and the ITM rotate against one another. In some examples the adhesion promoting composition may be applied directly to the ITM, for example by spraying the adhesion promoting composition onto the ITM or an additional roller may be provided to apply the adhesion promoting composition to the ITM.

The adhesion promoting composition is then dried on ITM 20 to form an adhesion promoting layer. The adhesion promoting composition may also be heated on the ITM 20 such that the adhesion promoting composition becomes tacky, for example as the adhesion promoting composition is heated towards or to the softening temperature of the adhesion promoter.

In some examples, the method comprises heating the adhesion promoting composition on the ITM, for example heating the adhesion promoting composition such that the adhesion promoter becomes tacky. In some examples, the method comprises heating the adhesion promoter to form a tacky film on the ITM. In some examples, the adhesion promoting composition is heated to a temperature of at least about the softening temperature of the adhesion promoter on the ITM.

The developed ink image and adhesion promoting layer are then transferred from the ITM 20 to a print substrate 62 which may be fed to the ITM from print substrate feed tray 60. In some examples, the print substrate 62 is fed into the printing apparatus by the print substrate feed tray 60 and is wrapped around an impression cylinder 50 before the developed ink image and adhesion promoting layer are transferred to the print substrate. In some examples, the print substrate 62 is a print substrate which is too long to be wrapped completely around the impression cylinder 50, in such cases the print substrate may be partially wrapped around the impression cylinder. For print substrates which are too large to be fully wrapped around the impression cylinder it may be necessary to use a one shot printing mode to print images on the print substrate.

Between the first and second transfers the solid content of the developed ink image and adhesion promoting layer is increased. The ink and the adhesion promoter may be heated on the ITM 20 such that the solids of the developed ink image may be fused and the adhesion promoter becomes tacky. For example, the solid content of the developed image deposited on the outer release layer 30 after the first transfer is typically around 20%, by the second transfer the solid content of the developed image is typically be around 80-90%. This drying and fusing is typically achieved by using elevated temperatures and air flow assisted drying. In some examples, the ITM 20 is heatable.

EXAMPLES

The following illustrates examples of the compositions and related aspects described herein. Thus, these examples should not be considered to restrict the present disclosure, but are merely in place to teach how to make examples of compositions of the present disclosure.

Example 1

An adhesion promoting composition was provided by combining a tackifier and a carrier liquid. The tackifier used was Dymerex polymerised resin (a dimerized acid rosin, available from Eastman having a number average molecular weight (Mn) of 412 and a ring and ball softening point, determined by ASTM E 28, of 144° C.). The carrier liquid used was Isopar L®. Isopar L® was added to Dymerex polymerised resin to produce an adhesion promoting composition containing 5 wt. % Dymerex polymerised resin by total weight of the adhesion promoting composition, the Dymerex polymerised resin being dissolved in the carrier liquid.

A HP Indigo 7500 press was provided as a liquid electrostatic printing apparatus along with CMKY liquid electrostatic ink compositions (cyan, magenta, yellow and black ElectoInk® 4.5 available from HP Indigo). The HP Indigo 7500 press comprises a photo-imaging plate on which a latent electrostatic image may be formed and an intermediate transfer member (ITM) as described in connection with the liquid electrostatic printing apparatus shown in FIG. 1. The HP Indigo 7500 press was operated in one-shot mode to produce a CMKY developed ink image on the ITM, followed by two wet null cycles (application of Isopar only to the photo-imaging plate, and subsequent transfer to the ITM) before the adhesion promoting composition was then applied to the CMKY developed ink image on the ITM. The adhesion promoting composition was applied to the CMKY developed ink image on the ITM using a BID unit to apply the adhesion promoting composition from the developer roller of the BID unit to the photo-imaging plate (without the application of a developer voltage) to form a adhesion promoting layer on the photo-imaging plate. As the photo-imaging plate and the ITM (on which the CMKY developed ink image is disposed) rotate against one another the adhesion promoting layer is transferred from the photo-imaging place to the CMKY developed ink image disposed on the ITM. Following the transfer of the adhesion promoting layer to the CMKY developed image disposed on the ITM, an additional wet null cycle was completed before an additional adhesion promoting layer was transferred to the ITM to form a double thickness adhesion promoting layer disposed on the CMKY developed ink image disposed on the ITM. A further wet null cycle was then completed before the CMKY developed ink image and the adhesion promoting layer were transferred to a print substrate (in this example, the print substrate used was 135 gsm Euro Art gloss substrate from Sappi) to produce a printed substrate comprising a pint substrate with an adhesion promoting layer disposed thereon and a CMKY image disposed on the adhesion promoting layer. Six printed substrates were produced following this method, three having 100% ink coverage (25% coverage of each of CMKY), one having 200% ink coverage (50% coverage of each of CMKY), one having 300% ink coverage (75% coverage of each of CMKY) and one having 400% ink coverage (100% coverage of each of CMKY).

Figure 2:
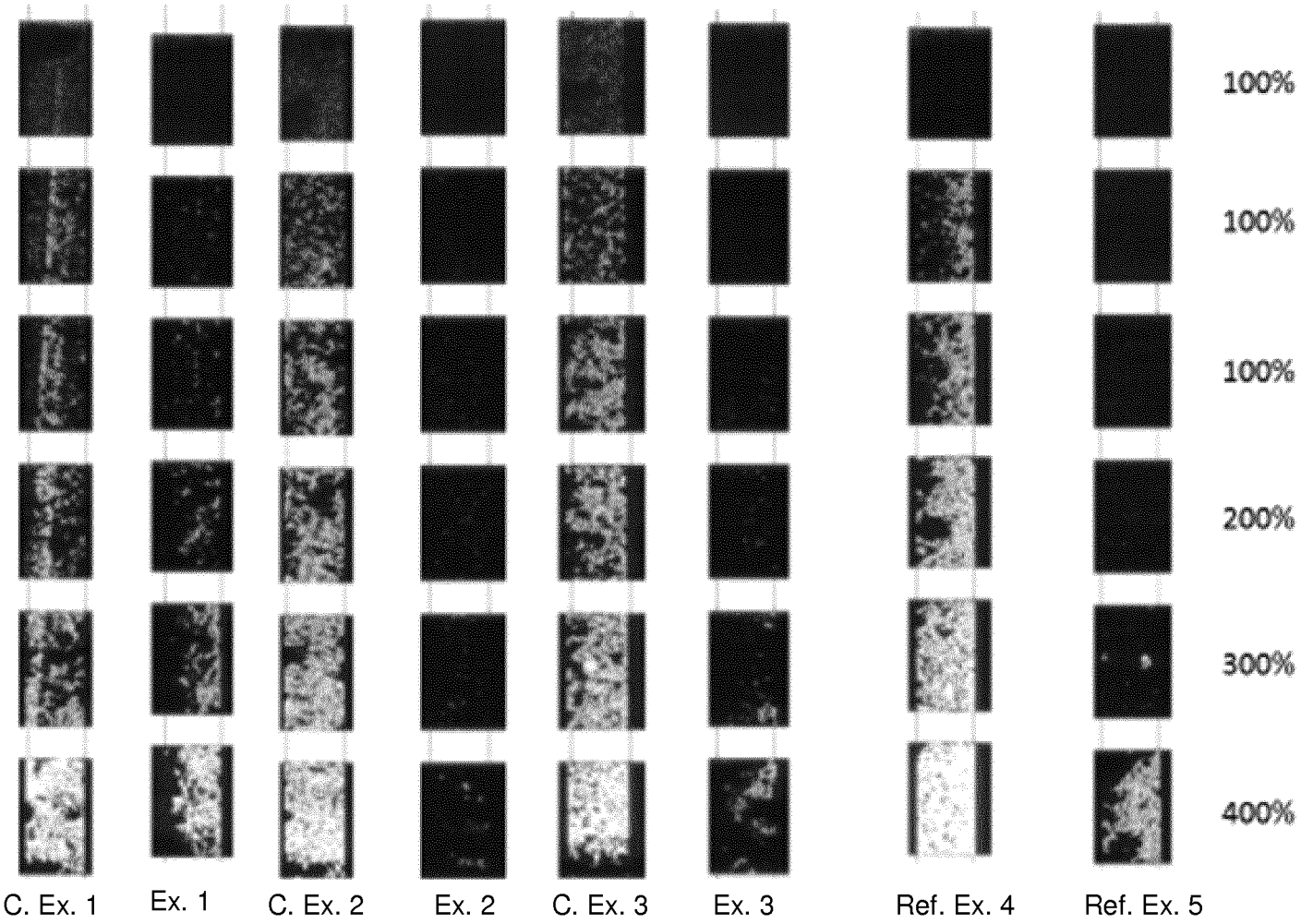
FIG. 2 shows the results of the peeling tests carried out on samples produced according to the Examples, Comparative Examples and Reference Examples described herein.

Each of the samples were tested for peeling using a 3M 230 adhesive tape to peel ink from the samples. The adhesive tape was applied to each of the samples and left for 10 minutes before being peeled from the samples. The samples were inspected visually for peeling, the results are shown in FIG. 2.

Comparative Example 1

Printed substrates were produced and tested as for Example 1 except that no adhesion promoting composition was used, (the wet null cycles were carried out for fair comparison).

Example 2

Printed substrates were produced and tested as for Example 1 except that the adhesion promoting composition used contained 8 wt. % Dymerex polymerised resin.

Comparative Example 2

Printed substrates were produced and tested as for Example 2 except that no adhesion promoting composition was used, (the wet null cycles were carried out for fair comparison).

Example 3

Printed substrates were produced and tested as for Example 1 except that the adhesion promoting composition used contained 10 wt. % Dymerex polymerised resin.

Comparative Example 3

Printed substrates were produced and tested as for Example 3 except that no adhesion promoting composition was used, (the wet null cycles were carried out for fair comparison).

Reference Example 4

Printed substrates were produced and tested as for Example 1 except that no adhesion promoting composition was used and no wet null cycles were employed.

Reference Example 5

Printed substrates were produced and tested as for Reference Example 5 except that the HP Indigo 7500 press was used in multi-shot mode.

FIG. 2 shows that the adhesion performance for the samples of Examples 1, 2 and 3 is much improved over the adhesion performance for the samples of comparative Examples 1, 2 and 3 which employed no adhesion promoter. It can also be seen that that the sample produced in Examples 2 and 3 with a greater amount of adhesion promoter provide superior adhesion performance to the samples produced in multi-shot mode (Reference Example 5). Comparison of the tested samples of Reference Example 4 with those of Comparative Examples 1-3, show that the wet null cycles have little impact on adhesion performance.

The present inventors have found that depositing the adhesion promoting composition on the ITM provides for improved adhesion and also allows for duplex printing in which adhesion is improved.

The present inventors have also found that the use of an adhesion promoting composition also improves adhesion in images produced in multi-shot mode.

The present inventors also carried out similar tests using adhesion promoting compositions employing Regalite S5100 (a hydrocarbon resin available from Eastman), Regalite R1100 (a hydrogenated hydrocarbon resin available from Eastman), Sylvares TP-105 (a terpene phenolic resin available from Arizona), Sylvatac RE 95 (a rosin ester available from Arizona), Sylvares TR B115 (a polyterpene available from Arizona), or Nures TP 100 (a terpene phenolic resin available from Newport Industries). Similar improvements in adhesion were observed when each of these adhesion promoting compositions were used.

While the methods and related aspects have been described with reference to certain examples, it will be appreciated that various modifications, changes, omissions, and substitutions can be made without departing from the spirit of the disclosure. It is intended, therefore, that the methods and related aspects be limited only by the scope of the following claims. Unless otherwise stated, the features of any dependent claim can be combined with the features of any of the other dependent claims.

The invention claimed is:

1. A liquid electrostatic printing method comprising:

providing a liquid electrostatic ink composition comprising a carrier liquid and chargeable particles comprising a resin;

providing an adhesion promoting composition comprising an adhesion promoter including a tackifier, wherein the tackifier includes a hydrocarbon resin, a hydrogenated hydrocarbon resin, an acid rosin, a terpene phenolic resin, a rosin ester, or a polyterpene;

contacting the liquid electrostatic ink composition with a latent electrostatic image disposed on a surface to create a developed ink image;

transferring the developed ink image to an intermediate transfer member;

depositing the adhesion promoting composition on the intermediate transfer member to form an adhesion promoting layer;

transferring the adhesion promoting layer to a print substrate; and transferring the developed ink image to the print substrate, such that the adhesion promoting layer is disposed on the print substrate and the developed ink image is disposed on the adhesion promoting layer.

2. A method according to claim 1, wherein the adhesion promoting composition is deposited on the developed ink image disposed on the intermediate transfer member to form an adhesion promoting layer disposed on the developed ink image and wherein the adhesion promoting layer and the developed ink image are transferred together from the intermediate transfer member to the print substrate.

3. A method according to claim 1, wherein the adhesion promoting composition is deposited on the intermediate transfer member before the developed ink image is transferred to the intermediate transfer member.

4. A method according to claim 1, wherein the tackifier has a number average molecular weight, Mn, in the range of about 400 to about 5000.

5. A method according to claim 1, wherein the tackifier has a number average molecular weight, Mn, in the range of about 400 Mn to about 1000 Mn.

6. A method according to claim 1, wherein the tackifier has a softening temperature in the range of about 80° C. to about 160° C.

7. A method according to claim 1, wherein a plurality of electrostatic ink compositions are provided, each of the plurality of electrostatic ink compositions are contacted with a latent electrostatic image on the surface to form a developed ink image and each of the developed ink images are transferred to the intermediate transfer member before transfer to a print substrate.

8. A method according to claim 7, wherein each of the developed ink images are transferred to the intermediate transfer member such that each of the developed ink images are disposed on the intermediate transfer member to form a multi-layered developed ink image on the intermediate transfer member and the adhesion promoting composition is deposited on the multi-layered developed ink image to form an adhesion promoting layer disposed on the multi-layered developed ink image disposed on the intermediate transfer member, and wherein the adhesion promoting layer and the multi-layered developed ink image are transferred together from the intermediate transfer member to the print substrate.

9. A method according to claim 1, wherein the adhesion promoting composition comprises a carrier liquid in which the adhesion promoter is dissolved.

10. A method according to claim 1, wherein the adhesion promoting composition comprises at least about 2 wt. % of the adhesion promoter by total weight of the adhesion promoting composition.

11. A method according to claim 10, wherein the adhesion promoting composition comprises about 2 wt. % to about 40 wt. % of the adhesion promoter by total weight of the adhesion promoting composition.

12. A method according to claim 1, wherein the resin of the liquid electrostatic ink composition comprises a copolymer of an alkylene monomer and a monomer selected from acrylic acid and methacrylic acid.

13. A method according to claim 1, wherein the electrostatic ink composition comprises a colorant.

14. A method according to claim 1, wherein the tackifier includes a polar functional group.

15. A method according to claim 1, wherein the adhesion promoting composition has a dynamic viscosity at 20° C. of less than about 50 cP.

* * * * *